US005547489A

United States Patent [19]

Inagaki et al.

[11] Patent Number: 5,547,489

[45] Date of Patent: Aug. 20, 1996

[54] PROCESS FOR PRODUCING LOW-CARBON CHROMIUM-CONTAINING STEEL

[75] Inventors: Yoshio Inagaki; Motoshi Shinkai, both of Higashiura; Masahide Tsuno; Akihiro Nagatani, both of Tokai, all of Japan

[73] Assignee: Daido Tokushuko Kabushiki Kaisha, Nagoya, Japan

[21] Appl. No.: 445,947

[22] Filed: May 22, 1995

[30] Foreign Application Priority Data

Jun. 20, 1994 [JP] Japan ..... 6-162616

[51] Int. Cl.[6] ..... C21C 7/10

[52] U.S. Cl. ..... 75/512; 75/548

[58] Field of Search ..... 75/548, 512

[56] References Cited

FOREIGN PATENT DOCUMENTS

| | | | |
|---|---|---|---|
| 1294818 | 11/1989 | Japan | 75/512 |
| 403257115 | 11/1991 | Japan | 75/512 |
| 2281312 | 3/1995 | United Kingdom | 75/512 |

*Primary Examiner*—Deborah Yee

*Attorney, Agent, or Firm*—Armstrong, Westerman, Hattori, McLeland & Naughton

[57] ABSTRACT

In the production of stainless steel it is aimed at to depress the highest temperature reaching during refining the molten steel with keeping the necessary tapping temperature so as to prolong the life of refractory materials of the refining furnace. After carrying out decarburization treatment under atmospheric pressure in a refining furnace by blowing an oxygen-containing gas into molten steel, further decarburization of the molten steel and reduction of chromium oxides is carried out under stirring by blowing a non-oxidizing gas under a reduced pressure, and then, reducing agent is charged into the furnace to reduce chromium oxides under keeping the reduced pressure. At the above atmospheric pressure operation total quantity of the oxygen gas blown is smaller than in a conventional process, while at the final stage of the reduced pressure operation an oxygen-containing gas is blown again in the quantity which is equivalent to the balance of the quantity of oxygen gas usually blown in the conventional process and the quantity of oxygen gas blown at the above atmospheric pressure operation so as to cause heat generation by oxidation reaction of chromium thereby increasing molten steel temperature to a necessary temperature with anticipation of subsequent temperature decrease.

1 Claim, 2 Drawing Sheets

PROCESS FOR PRODUCING LOW-CARBON CHROMIUM-CONTAINING STEEL

BACKGROUND OF THE INVENTION

The present invention concerns a process for producing low-carbon chromium-containing steel.

In the process for producing low-carbon chromium-containing steel such as stainless steels it is practiced to blow an oxygen-containing gas into molten steel in a refining furnace in the atmosphere for the purpose of decarburizing the molten steel to lower the carbon level therein. This process is well known as AOD process.

The decarburization refining in the atmosphere becomes inefficient when the carbon level in the molten steel becomes low because oxygen gas blown into the molten steel is not used for decarburization but oxidizes chromium and thus decarburization efficiency gradually decreases.

On this basis the applicant proposed an improved process for refining steel, which comprises the steps of decreasing pressure in the refining furnace to 20–200 Torr at the stage where carbon content is still in a relatively high level, say 0.2%, blowing only non-oxidizing gas such as Ar into the molten steel to stir the molten steel and the slag, thereby causing reaction between chromium oxides formed during the atmospheric pressure operation and the carbon in the molten steel for decarburization and partial reduction of the chromium oxides.

This process has merits of carrying out decarburization refining in a short period of time as well as decreasing consumption of expensive Argon gas, and further, improved yield of chromium.

The process, however, has a drawback that the temperature of the molten steel increases to a high level and thus, life of refractory materials in the refining furnace becomes short.

More specifically, at the stage of the atmospheric pressure operation blowing oxygen-containing gas into the molten steel causes exothermic reactions to increase the temperature of the molten steel, and at the subsequent stage of reduced pressure operation endothermic reactions of chromium oxides and the carbon in the molten steel as well as charging of additives such as deoxidizers cause temperature decrease of the molten steel.

On the other hand, it is necessary to maintain the molten steel temperature at tapping, for facilitating subsequent casting, at a certain level or certain degrees higher than the melting point of the steel.

Therefore, in practice of the above described process which comprises the atmospheric pressure operation and the subsequent reduced pressure operation it is necessary to blow excess oxygen gas in the atmospheric pressure operation to have the molten steel temperature increased in anticipation of temperature decrease during the reduced pressure operation so that the molten steel temperature may be maintained at a certain level or higher.

In this practical operation the molten steel necessarily reaches, even for a short period of time, to an extremely high temperature, and this high temperature shortens life of refractory materials of the refining furnaces.

SUMMARY OF THE INVENTION

The object of the present invention is to solve the above mentioned problems and provide an improved method of producing low-carbon chromium-containing steel.

The method of this invention comprises: A process for producing a low-carbon chromium-containing steel containing 5% or more of chromium, comprising: atmospheric pressure operation carried out by blowing an oxygen-containing gas into a molten steel charged in a refining furnace in atmosphere to decarburize the steel, and reduced pressure operation carried out by decreasing the pressure in the furnace to 20–200 Torr, blowing a non-oxidizing gas into the molten steel and by stirring the molten steel and slag in the furnace to cause reaction of chromium oxides in the slag and carbon in the molten steel so as to decarburize the steel, and then, reducing the chromium oxides by charging a reducing agent under keeping the reduced pressure; wherein the total quantity of the oxygen gas in the oxygen-containing gas blown during the atmospheric pressure operation is decreased, while the oxygen-containing gas is blown again into the molten steel at the final stage of decarburization in the reduced pressure operation with such an oxygen gas quantity as equivalent to the oxygen gas quantity reduced from the oxygen-containing gas blown in the atmospheric pressure operation so as to cause heat generation by oxidation reaction of chromium, thereby to increase temperature of the molten steel to a determined temperature which is required from the view to cover temperature decrease during the subsequent stage.

DETAILED EXPLANATION OF THE PREFERRED EMBODIMENTS

As described above, the present invention is characterized by blowing the oxygen-containing gas into the molten steel again at the latter part of decarburization period of the reduced pressure operation so as to increase the molten steel temperature to a certain temperature necessitated by the anticipated temperature decrease thereafter.

In the practice of the above, total quantity of $O_2$ gas blown is reduced, and oxygen gas of the quantity equivalent to the balance of the full and the reduced quantities of the oxygen gas is blown at the final stage of decarburization period in the reduced pressure operation.

In other words, temperature increase of the molten steel is realized in two steps without changing the total thermal balance. As the result, it is possible to lower the highest temperature in the atmospheric pressure operation, and thus, to prolong life of the refractory materials.

The chromium oxides formed by the latter blowing of the oxygen-containing gas is reduced by adding reducing agents Necessary amounts of the reducing agents may not be larger than in the conventional process.

Thus, from comparison of the process of the invention and the conventional process, there is found no difference either in the quantities of the oxygen gas to be blown, the quantities of the chromium oxides formed, or the quantities of the reducing agents to be charged, and therefore, in the present process the molten steel temperature at tapping is maintained to the same level as that of the convention process.

EXAMPLES

Examples of this invention will be described below in detail.

A 18Cr-8Ni stainless steel was prepared by melting in an arc furnace. As shown in FIG. 2, molten steel 10 was transferred to a refining furnace 12 and subjected to decarburization by blowing a mixed gas of oxygen gas and Argon gas through a tuyere 18 near the bottom of the furnace under atmospheric pressure. The ratios of the oxygen gas to the Argon gas were altered in three levels, as shown in FIG. 1, as the carbon contents in the molten steel decreased.

In this stage heat is generated by the reactions of oxygen with carbon and chromium in the molten steel and the temperature of the molten steel 10 increases.

Figure 1:
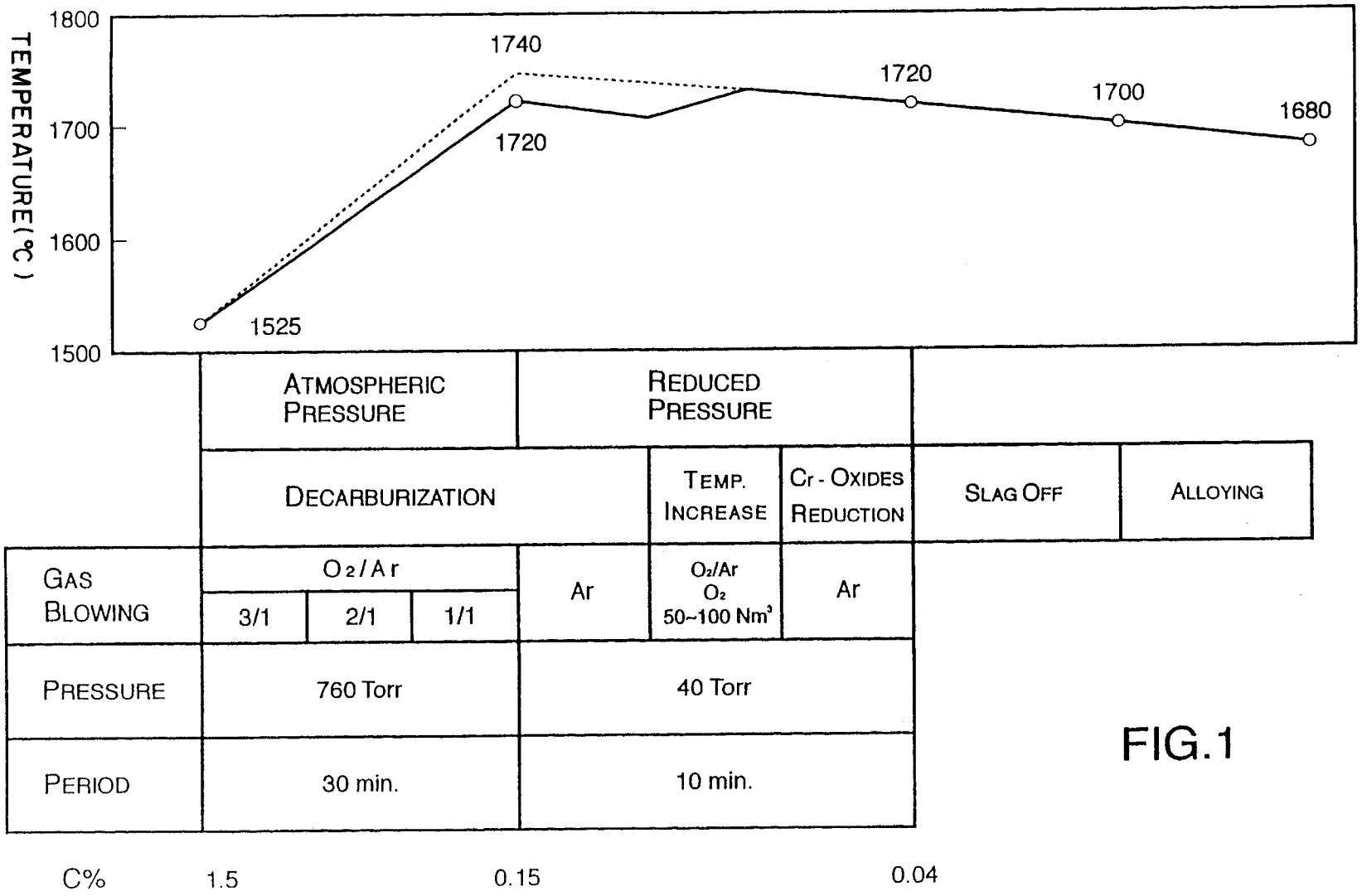
FIG. 1 is a graph showing temperature change of the molten steel in connection with the stages of the present process.
Figure 2:
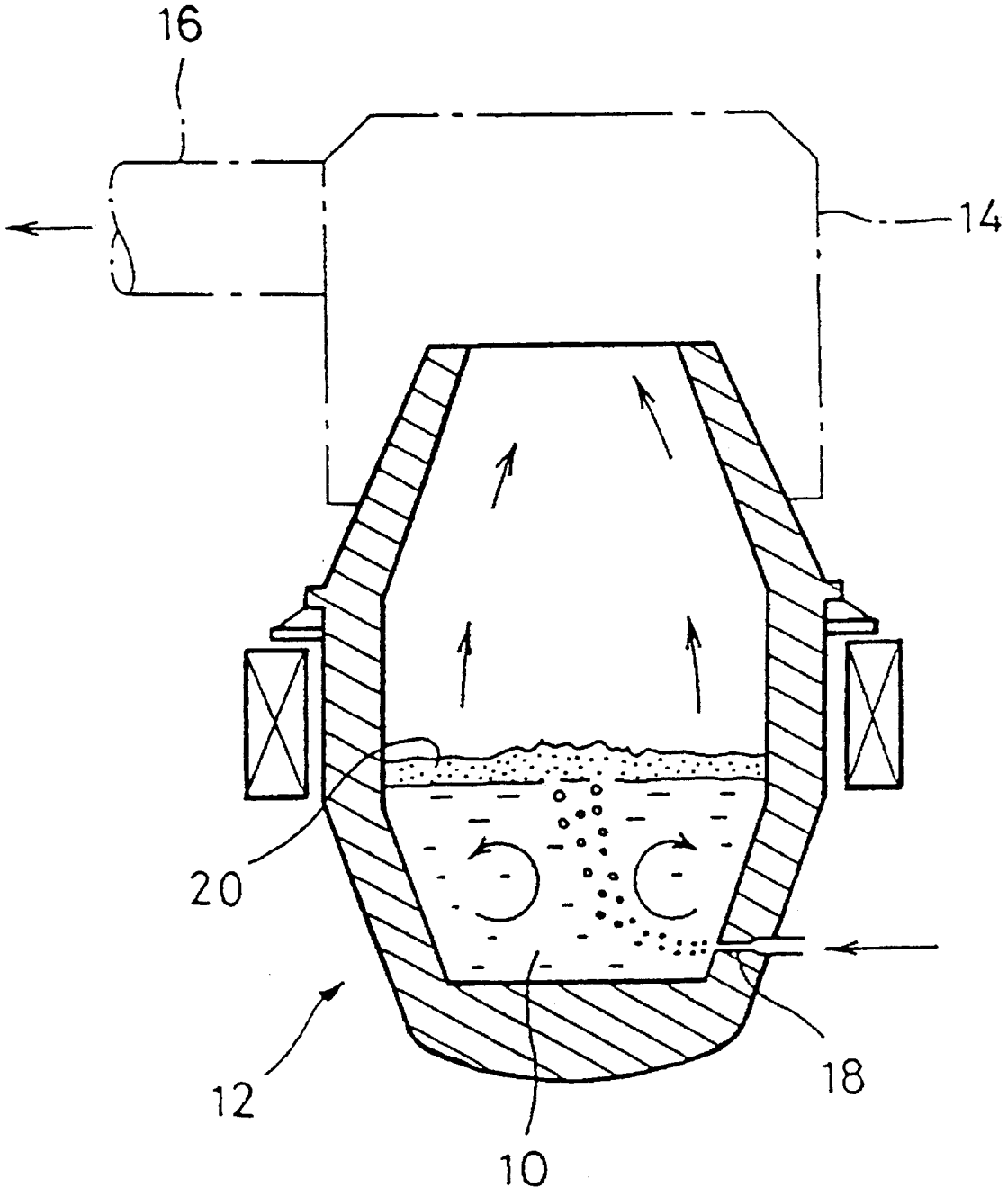
FIG. 2 is a vertical section view of the furnace illustrating an important stage of the present process.

In the case where the molten steel was decarburized in accordance with a conventional process, temperature of the molten steel 10 increased in this stage to 1740° C. as shown with the broken line "B" in FIG. 1, while in the present process, due to reduction of the total quantity of oxygen blowing during the atmospheric pressure operation the highest temperature was depressed to 1720° C. as shown with the solid line "A" in the Figure.

The temperature of the molten steel at the beginning of the refining was 1525° C., and the carbon content was 1.5%.

When the carbon content in the molten steel 10 decreased to 0.15% the refining furnace 12 was covered with a lid to seal and evacuated through a duct 16 to 40 Torr. Then, only Argon gas was blown through the tuyere 18.

Blowing gas under a reduced pressure caused vigorous stirring of the molten steel 10 and the slag 20, and as the results of reactions of chromium oxides in the slag 20 to carbon in the molten steel, decarburization and reduction of the chromium oxides proceeded.

The reactions in total were endothermic and thus temperature of the molten steel 10 decreased. (see FIG. 1)

An $O_2$/Ar mixed gas was then blown into the molten steel again under keeping the reduced pressure. Total quantity of oxygen gas was adjusted to be 50–100 $Nm^3$, which is equivalent to the balance of the quantity of oxygen gas usually blown in a conventional process and the quantity of oxygen gas blown at the above atmospheric pressure operation according to the invention. In other words, blowing oxygen gas was carried out at this temperature increasing stage in such a manner that the total quantity of blown oxygen gas is the same as that of the conventional process.

Blowing oxygen gas causes oxidation of chromium, and due to the exothermic reactions temperature of the molten steel 10 increases again. The temperature of the molten steel will be the same as the temperature at the beginning of reduction treatment in accordance with the conventional process.

Finally, under keeping the reduced pressure, the gas blown was switched from the mixed gas to Argon gas only, and ferrosilicon was charged into the molten steel to reduce the above formed chromium oxides. The refined steel was then tapped. Temperature at tapping was 1680° C.

As explained above with reference to a working example, the highest temperature in refining can be depressed while the necessary tapping temperature is maintained. Thus, life of the refractory material of the refining furnace 12 is prolonged.

The above description is made just for exemplifying the invention, and the present process can be practiced with various modifications in the scope of the invention.

We claim:

1. A process for producing a low-carbon chromium-containing steel containing 5% or more of chromium, comprising:

atmospheric pressure operation carried out by blowing an oxygen-containing gas into a molten steel charged in a refining furnace in atmosphere to decarburize the steel, and reduced pressure operation carried out by decreasing the pressure in the furnace to 20–200 Torr, blowing a non-oxidizing gas into the molten steel and by stirring the molten steel and slag in the furnace to cause reaction of chromium oxides in the slag and carbon in the molten steel so as to decarburize the steel, and then, reducing the chromium oxides by charging a reducing agent under keeping the reduced pressure;

wherein the total quantity of the oxygen gas in the oxygen-containing gas blown during the atmospheric pressure operation is decreased, while the oxygen-containing gas is blown again into the molten steel at the final stage of decarburization in the reduced pressure operation with such an oxygen gas quantity as equivalent to the oxygen gas quantity reduced from the oxygen-containing gas blown in the atmospheric pressure operation so as to cause heat generation by oxidation reaction of chromium, thereby to increase temperature of the molten steel to a determined temperature which is required from the view to cover temperature decrease during the subsequent stage.

* * * * *